US005823829A

United States Patent [19]

Suzuki

[11] Patent Number: 5,823,829

[45] **Date of Patent: *Oct. 20, 1998**

[54] CONNECTION BODY'S FITTING CONNECTION STRUCTURES AND SOCKETS STRUCTURES TO HOLD AN ELECTRIC BULB

[76] Inventor: Hiroyuki Suzuki, 1309, Bukko-cho, Hodogaya-ku, Yokohama-shi, Kanagawa 240, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 770,848

[22] Filed: Dec. 20, 1996

Related U.S. Application Data

[63] Continuation of Ser. No. 307,795, Dec. 8, 1994, abandoned.

[30] Foreign Application Priority Data

Jan. 31, 1993 [JP] Japan ..... 5-049827
Oct. 5, 1993 [JP] Japan ..... 5-271178

[51] Int. Cl.[6] ..... H01R 17/18

[52] U.S. Cl. ..... 439/668; 439/665; 439/846

[58] Field of Search ..... 439/188, 611–619, 439/842, 843, 851, 668, 699.2, 336, 339, 340, 356, 360, 375, 414, 419, 558, 846, 665

[56] References Cited

U.S. PATENT DOCUMENTS

| | | | |
|---|---|---|---|
| 1,237,718 | 8/1917 | Speice | 439/843 |
| 2,549,577 | 4/1951 | Coyle | 439/843 |
| 3,678,451 | 7/1972 | Boliver | 439/843 |
| 4,369,707 | 1/1983 | Budde | 439/188 |
| 4,572,606 | 2/1986 | Neumann et al. | 439/843 |
| 5,069,632 | 12/1991 | Avitan | 439/188 |
| 5,106,328 | 4/1992 | Prochaska et al. | 439/843 |
| 5,261,837 | 11/1993 | Kilsdonk et al. | 439/617 |

FOREIGN PATENT DOCUMENTS

| | | | |
|---|---|---|---|
| 1118303 | 11/1961 | Germany | 439/843 |
| 0022476 | 12/1961 | Germany | 439/843 |
| 0570552 | 12/1957 | Italy . | |
| 49-29022 | 8/1974 | Japan . | |
| 50-51181 | 5/1975 | Japan . | |
| 51-39413 | 9/1976 | Japan . | |
| 56-72484 | 6/1981 | Japan . | |
| 57-201784 | 12/1982 | Japan . | |
| 63-79052 | 5/1988 | Japan . | |

OTHER PUBLICATIONS

Japanese Utility Model Publication No. 49—29022.
Japanese Utility Model Application No. 50—51181.
Japanese Utility Model Publication No. 51—39413.
Japanese Utility Model Application No. 56—72484.
Japanese Utility Model Application No. 57—201784.
Japanese Utility Model Application No. 63—79052.

*Primary Examiner*—Neil Abrams
*Assistant Examiner*—Tho Dac Ta
*Attorney, Agent, or Firm*—Bell, Boyd & Lloyd

[57] ABSTRACT

In the structure to fit an electric bulb base into its socket and hold it there, the plate springs are provided at plural positions at some interval on the inner circumference of the hollow part of the said socket-shaped connector; each of these plate springs is provided in the direction from the proximity of opening to the recess of the said hollow part; so that the minimum inner circumference of the said hollow part formed by the presence of at least one of the plural plate springs may be smaller than the outer plug circumference of the plug-shaped connector. Further this invention is applicable to the socket structure to hold an electric bulb by using it as the plug-shaped connector, and its socket as the socket-shaped connector.

10 Claims, 6 Drawing Sheets

CONNECTION BODY'S FITTING CONNECTION STRUCTURES AND SOCKETS STRUCTURES TO HOLD AN ELECTRIC BULB

This is a continuation of application Ser. No. 08/307,795, filed on Dec. 8, 1994 now abandoned.

TECHNICAL FIELD

This invention is related to the structure of a socket-shaped connector into which a plug-shaped connector is fitted for their connection, and to the structure of a socket into which an electric bulb is fitted to be held.

BACKGROUND TECHNIQUE

In the conventional incandescent electric bulb, bulb-type fluorescent lamp and other various electric bulbs, the socket structure to hold and connect an electric bulb therewith is that as shown in FIG. 15, while a female thread (c) is formed on the internal wall surface of the hollow part (b) of the socket (a), a male thread (f) is formed around the base (e) of an electric bulb (d), and this bulb's base (e) is screwed into the hollow part (b) of the socket (a), making an electrode (g) provided on the end of the bulb's base (e) contact an electrode (h) located at the most recessed part of the hollow part (b) of the socket (a), with the male thread (f) of the electric bulb base (e) used as the other electrode and the socket's female thread (c) as the other terminal. And the lead wires (i) and (j) are led out from terminals electrically connected with the electrode (h) and the female thread (c).

However, such a conventional method to connect an electric bulb with a socket was a screw-in method requiring a troublesome work to turn the electric bulb (d) several times with hand, after adjusting the male thread (f) around the bulb base (e) to the center line of the female thread (c) in the hollow part (b) of the socket (a). Moreover, this connection work has often to be done at a high position, where the worker has to fully stretch his arm upward for turning the electric bulb with his fingers into the socket. In this case, there is danger that he may lose his bodily balance, fall onto the floor and be injured. The danger also attends when the worker screws off the electric bulb from the socket.

Such situations are not limited to the case of the electric bulb and its socket, but generally include the case where a conventional screw-in type connection body is screwed into a socket-shaped connector.

In order to solve these problems, the object of this invention is to provide the socket structure to connect and hold an electric bulb which can provide very simple and highly strong connection, and more generally, the socket-shaped connectors' structure where the plug-shaped connector, including electric bulbs, are fitted in for the connection.

DISCLOSURE OF THE INVENTION

According to the first invention, in the structure to fit a plug-shaped connector in a socket-shaped connector, a plate spring is provided at a position on the internal circumference of the hollow part in the said socket-shaped connector, and the said plate spring is made to protrude into the inner space of the said hollow part at least at one part thereof so that the minimum diameter of the circumference consisting of the said plate spring and the inner circumference of said hollow part can be smaller than the diameter of the outer circumference of the plug of said plug-shaped connector. According to this invention, when the plug-shaped connector end is inserted under pressure into the hollow part of the socket-shaped connector, the connector, though the diameter of its minimum inner circumference is smaller than the diameter of the plug's outer circumference due to the existence of the plate spring, accepts the plug because the plate spring deforms by the insertion force of the plug, and in this state, the plate spring pushes the said plug's outer surface with its own elastic force. By this, the plug-shaped connector is fitted in and connected with the socket-shaped connector. For removing the plug-shaped connector from the socket-shaped connector, it is enough to draw off the plug from the connector. According to this invention, therefore, the plug-shaped connector inserted under pressure into the socket-shaped connector can be strongly caught and held within the socket-shaped connector. For this reason, mounting and removing this connector is very easy; what is needed is to insert and draw off by throwing little more strength into your hand than usual, and no conventional troublesome action like screwing in is necessary. The plug-shaped connectors and the socket-shaped connectors according to this invention are suitable when applied to various types of connecting members, particularly to the automatic connection, removal, etc. of parts by the robots and other means.

According to the second invention, in the structure to fit a plug-shaped connector into a socket-shaped connector, plate springs are provided at plural positions located at some interval on the inner circumference of the socket-shaped connector's hollow part, these plate springs being arranged in the directions from the proximity of opening to the recess, so that the diameter of the minimum inner circumference, due to the existence of at least one of the spring plates, may be smaller than the diameter of the outer plug circumferential length of said plug-shaped connector. According to this invention, when the plug-shaped connector end is inserted under pressure into the hollow part of the socket-shaped connector, the connector, though the diameter of its minimum inner circumference passing through at least one of the said plate springs is smaller than the diameter of the plug's outer circumference, accepts the plug because the plate springs deform by the insertion force of the plug, and in this state, the plate springs push the plug's outer surface with their own elastic force. By this, the plug-shaped connector is fitted in and connected with the socket-shaped connector. For removing the plug-shaped connector from the socket-shaped connector, it is enough to draw off the plug from the connector. This invention therefore has the same effect as the first invention, but since in this case, plural plate springs are provided with the hollow part of socket-shaped connector, the plug-shaped connector is more fly held within the hollow with the force of these plate springs.

According to the third invention, in the structure to fit a plug-shaped connector into a socket-shaped connector, plate springs are provided at plural positions located at some interval on the inner circumference of the socket-shaped connector's hollow part, these plate springs being arranged in the directions from the proximity of opening to the recess, so that the diameter of the minimum inner circumference formed by the existence of at least one of the spring plates, may be smaller than the diameter of the outer plug circumference of the said plug-shaped connector. Further, a flange is provided around the outer circumference of the said plug-shaped connector body at such a position that when the plug is inserted into the socket-shaped connector, the flange can come deeper than the point of the minimum inner circumference formed by the existence of plural plate springs. According to this invention, when the plug-shaped connector end is inserted under pressure into the hollow part of the socket-shaped connector, the connector, though its minimum inner circumference formed at the position where there is at least one of the said plate springs is smaller than the plug's outer circumference and also the outer circumference of the flange, accepts the plug as the plate springs deform by the insertion force of the plug and the flange, and the said plug flange is positioned deeper than the point of minimum inner circumference part formed by the existence of plural plate springs after passing this point. In this state, the plate springs push the plug's outer surface with their own elastic force. For removing the plug-shaped connector from the socket-shaped connector, it is enough to draw off the plug from the connector. This invention therefore has the same effect as the first invention, but since, in this case, when the plug is pushed under pressure into the hollow of socket-shaped connector, the plug flange is positioned deeper than the point of minimum inner circumference formed by the plate springs after passing this point. If tried to be drawn off from the connector, the plug in this state is difficult to be done because its outer surface is pushed tight with the plate springs, and further the plug flange is fixed by its engagement with the minimum inner circumference area formed with the plate springs. In this invention, therefore, the plug can further tightly be fitted in and connected with the connector.

According to the fourth invention, in the structure to fit and hold the base of an electric bulb into its socket, the base is formed like a column and a plate spring is provided on the inner circumference of the socket, with at least one position of the said plate spring made to protrude into the inner socket space, so that the diameter of the minimum inner circumference formed by the existence of the said plate spring may be smaller than the diameter of the outer circumference of the said electric bulb base. According to this invention, when the bulb base is inserted under pressure into the socket, it, though the diameter of its minimum inner circumference is made smaller than the diameter of the outer circumference of the bulb by the existence of the plate spring provided within the socket, accepts the bulb as the plate spring deforms by the insertion force of the base. In this state, the plate spring pushes the outer surface of the said base by its own spring force. By this the electric bulb base is fitted and held within the socket. For removing the electric bulb from the socket, it is enough to merely draw off the electric bulb from the socket. Installing and removing the electric bulb are therefore very easy as they can be achieved safely with only little more strength thrown in the hand, which can eliminate the need of conventional troublesome work to align the bulb with the socket center line and turn it several times with hand. Moreover, once inserted, the base can be caught firmly by the force of the said plate spring provided within the socket. This bulb holding structure according to this invention is not only applicable to industrial and household electric bulbs, but incandescent lamps, fluorescent lamp-type electric bulbs, torch lamps, HID certifiers, automobile head and tail lamps, etc.

According to the fifth invention, in the structure to fit and hold the base of an electric bulb into its socket, the base is formed like a column and plural plate springs are provided at some interval on the inner circumference of the socket, these plural plate springs being arranged in the directions from the proximity of socket opening to the recess, so that the diameter of the minimum inner circumference formed by the existence of at least one of the plate springs may be smaller than the diameter of the outer circumference of the said electric bulb base. According to this invention, when the bulb base is inserted under pressure into the socket, it, though its minimum inner circumference formed with at least one of the plate springs provided there is smaller than the outer circumference of the bulb base, accepts the bulb as the plate springs deform by the insertion force of the base. In this state, the plate springs push the outer surface of the said base by its own spring force. By this the electric bulb base is fitted and held within the socket. For removing the electric bulb from the socket, it is enough to merely draw off the electric bulb from the socket. This invention therefore has the same effect as the fourth invention, but the plural plate springs provided in the socket reinforce the power to hold the electric bulb in the socket.

According to the sixth invention, in the structure to fit and hold the base of an electric bulb into its socket, the base is formed like a column and plural plate springs are provided at some interval on the inner circumference of the socket, these plural plate springs being arranged in the directions from the proximity of socket opening to its recess, so that the diameter of the minimum inner circumference formed by the existence of at least one of the plate springs may be smaller than the diameter of the outer circumference of the said electric bulb base. Further, a flange is provided around the outer circumference of the said bulb base at such a position that when the bulb base is inserted into the socket, the flange can come deeper than the point of the minimum inner circumference formed by the existence of plural plate springs. According to this invention, when the bulb base is inserted under pressure into the socket, it, though its minimum inner circumference formed at the position where there is at least one of the said plate springs provided within the socket at some interval is smaller than the bulb base's outer circumference and also the outer circumference of the flange, accepts the plug as the plate springs deform by the insertion force of the plug and the flange, and the said plug flange is positioned deeper than the point of minimum inner circumference part formed by the existence of plural plate springs after passing this point. In this state, the plate springs push the plug's outer surface with their own elastic force. By this, the bulb base is fitted and held in the socket. For removing the bulb base from the socket, it is enough to merely draw off the base from the socket.

This invention therefore has the same effect as the fourth invention, but when the bulb base is inserted under pressure into the socket, the said base flange passes over the minimum inner circumference area formed with the plate springs to be positioned deeper than the said area. Even if tried to be drawn off from the socket, the bulb base in this state is difficult to be done because its outer surface is pushed tight with the plate springs, and further the base flange is fixed by its engagement with the minimum inner circumference area formed with the plate springs. In this invention, therefore, the base can further tightly be fitted in and connected with the connector.

In each of the above explained inventions, the plate spring provided in the socket-shaped connectors may take a convex, corrugated or other appropriate shape in cross section along the direction from the proximity of opening to the recess.

According to the seventh invention, in the structure to fit and hold an electric bulb base in its socket, the said electric bulb base has a male thread on its outer circumference, and plate springs are provided at plural positions on the inner circumference of the said socket, these plate springs being arranged in the directions from the proximity of socket opening to its recess and shaped corrugated matching the male thread of the said bulb base, so that the minimum inner circumference formed by the existence of these plural plate springs may be smaller than the outer circumference of the said bulb base. According to this invention, when the bulb base is inserted under pressure into the socket, it, though its minimum inner circumference formed by the existence of corrugated plate springs is smaller than the maximum outer circumference of the said bulb base, accepts it as the plate springs deform by the insertion force of the said bulb base, and when it reaches the socket bottom, its male thread fits with the corrugation of each plate spring. In this state, each plate spring pushes the outer surface of the said bulb base by its own elastic force. By this, the bulb base is fitted and held in the socket. For removing the electric bulb from the socket, all what has to be done is merely to draw it off from the socket. This invention has the same effect as the fourth invention, but is also applicable to the screw-in type electric bulb in current use. It is highly convenient for its wide applicability.

BEST FORM TO EMBODY THIS INVENTION

Figure 1:
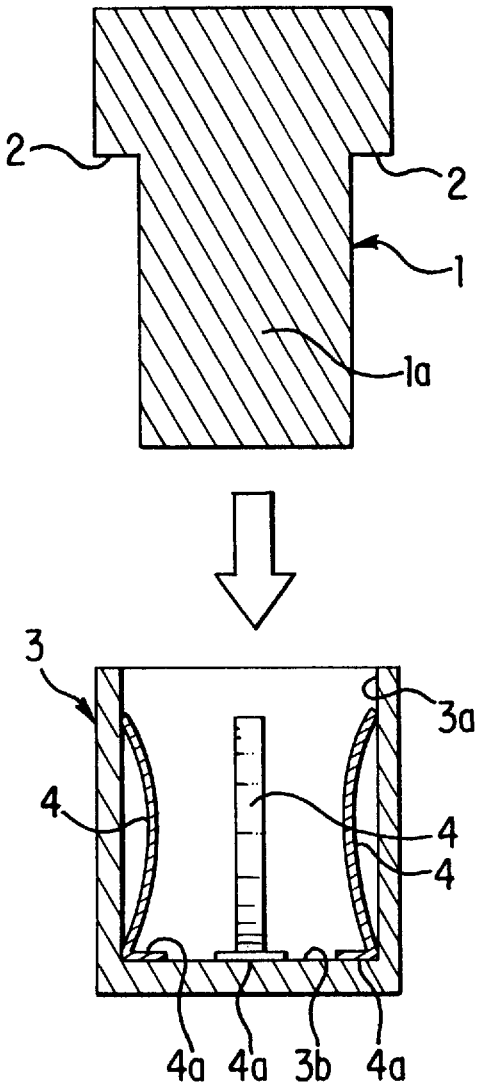
FIG. 1 shows each cross section of a plug-shaped connector and a socket-shaped connector in separate conditions of the first embodiment according to this invention.
Figure 2:
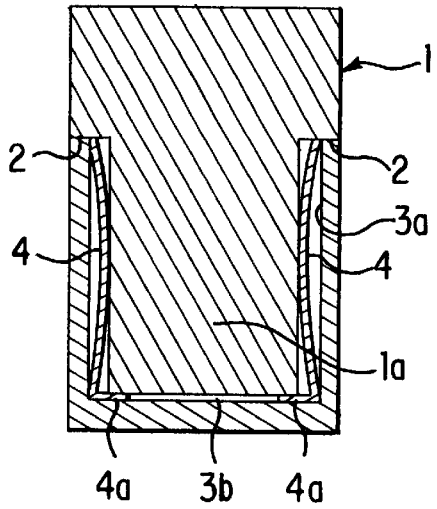
FIG. 2 shows a cross section of the plug-shaped connector and the socket-shaped connector in combined conditions of the first embodiment in FIG. 1.

FIGS. 1 and 2 show the first embodiment of this invention which provides a plug-shaped connector 1 consisting of a column-type plug part 1*a* capped with an annular stepped body 2, and a bottomed cylindrical socket-shaped connector 3 with the socket 3*a* where this plug-shaped connector 1 is fittable. Along the internal circumference of the socket 3*a* of this socket-like connector 3, are provided plural plate springs 4 at a 90° interval from one another in parallel with the center line, with these plate springs 4 having their bases 4*a* fixed on the bottom 3*b* of the socket 3*a*.

In this embodiment, as shown in FIG. 2, when the plug 1*a* of a plug-like connector 1 is inserted into the socket 3*a* of a socket-like connector 3, the plate springs 4 elongate via their elasticity by the insertion force of plug 1*a* to receive it until the annular stepped part 2 of plug 1 comes into contact with the opening edge of socket-like connector 3. In this state, each plate spring 4 pushes the outer circumference of plug 1*a* through its elasticity to restore its original conditions to prevent the plug-like connector 1 from easily falling off from the socket-like connector 3.

Figure 3:
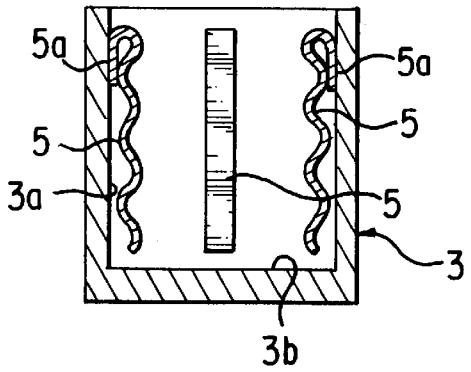
FIG. 3 shows a cross section of the socket-shaped connector of the second embodiment according to this invention.
Figure 4:
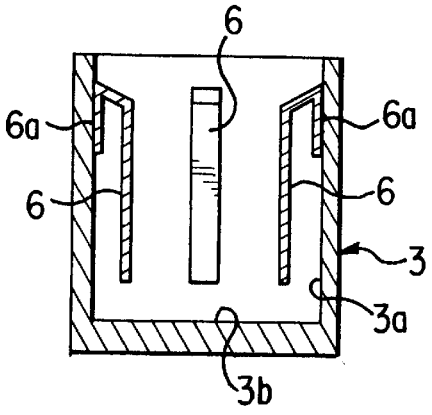
FIG. 4 shows a cross section of the socket-shaped connector of the third embodiment according to this invention.

Each plate spring 4 within the socket 3*a* of the said socket-like connector 3 is not limited in shape to a convex shape but may be such a corrugated plate spring 5 of the second embodiment as shown in FIG. 3 in which its base parts are fixed to the inner circumference area near the opening edge of the socket 3, or may be the flat-plate spring 6 as shown in FIG. 4 as the third embodiment of which base parts 6*a* are similarly fixed to the inner circumference area near the opening edge of the socket 3.

Figure 5:
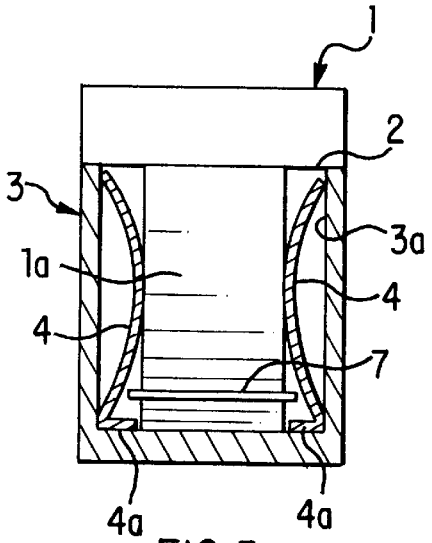
FIG. 5 shows a cross sectional view of a plug-shaped connector according to the fourth embodiment of this invention fitted into a socket-shaped connector.

In the fourth embodiment in FIG. 5, though the socket-like connector 3 has the same shape as the above first embodiment, the plug-like connector 1 has a flange 7 around the external end of its plug 1*a*. When this plug 1*a* of plug-shaped connector 1 is inserted into the socket 3*a* of socket-like connector 3, the plug 1*a* and the flange 7 presses each plate spring 4 to flatten it, and when the annular stepped part 2 of the plug-shaped connector 1 contacts the opening edge of the socket-shaped connector 3, the central convex part of each plate spring 4 pushes the outer surface of the plug 1*a* and its flange 7 enters deeper into the depressed area of each plate spring. Therefore even if this plug-shaped connector 1 is tried to be drawn off from the socket-shaped connector 3, it is hard to be done, because first each plate spring 4 pushes the outer circumference of plug 1*a* with its central convex part and second the flange 7 is caught by its engagement with these plate springs's convex areas.

Figure 6:
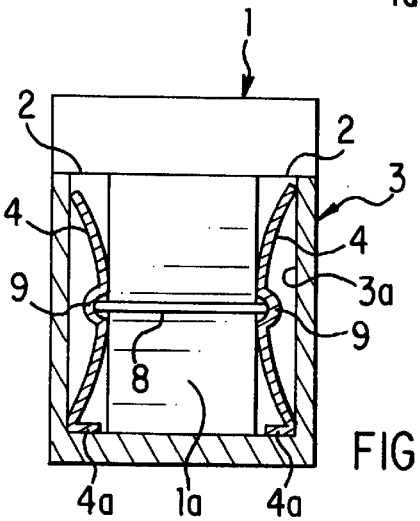
FIG. 6 shows a cross sectional view of the plug-shaped connector according to the fifth embodiment of this invention fitted into a socket-shaped connector.
Figure 7:
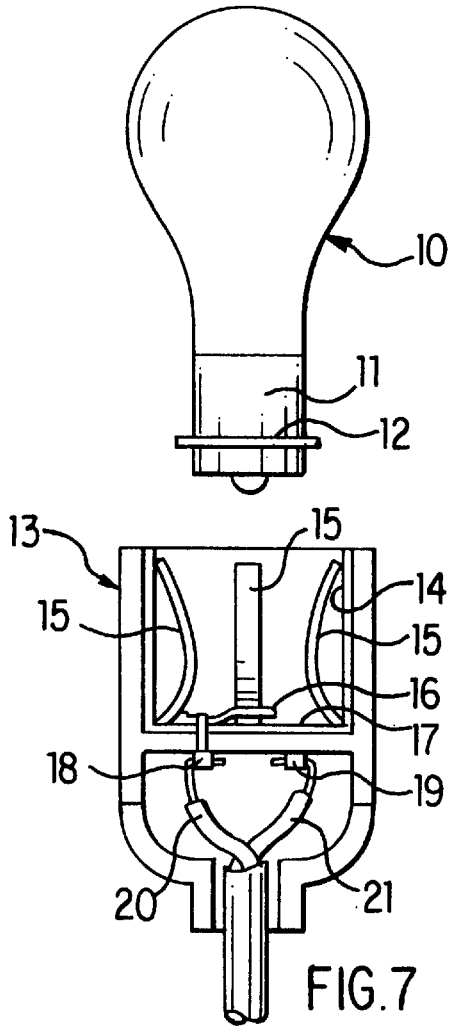
FIG. 7 shows each cross section of an electric bulb and a socket in separate conditions of the sixth embodiment of this invention.
Figure 8:
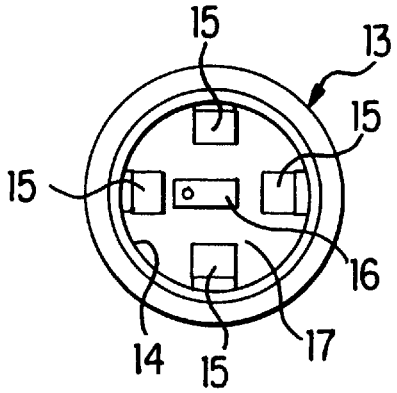
FIG. 8 shows a plan of the socket of the sixth embodiment according to this invention.

FIG. 6 shows the fifth embodiment of this invention, where the plug-shaped connector 1 has a flange 8 around the outer circumference of its plug 1*a*, and the socket-shaped connector 3 has each of its plate springs 4 provided with a groove 9 on its central convex height. When the plug 1*a* of the plug-shaped connector 1 is inserted into the socket 3*a* of socket-shaped connector 3, it presses and widens these plate springs 4, and when the annular stepped part 2 of the plug-shaped connector 1 contacts the opening edge of socket-shaped connector 3, the flange 8 of the plug 1*a* enters the groove 9 of each plate spring 4. Therefore even if the connector 1 is tried to be withdrawn from the socket-shaped connector 3, it is difficult to be done because first each plate spring 4 pushes the outer surface of the plug 1*a* with its central convex part and second the flange 8 is caught engaged with the groove 9 of each plate spring 4.

Then this invention is applied to the electric bulb socket to hold an electric bulb. In FIGS. from 7 to 9 that show the sixth embodiment of this invention, the base 11 of an electric bulb 10 is shaped to be a column, this column-shaped base 11 has a flange 12 around its outer circumference, and the socket 13 has plate springs 15 similar to the case of the first embodiment on its inner circumference 14, making these plate springs 15 the electrode on one hand. Meanwhile, the electrode 16 on the other is provided at the bottom 17 of the socket 14, drawing out of the socket 13 the lead wires 20 and 21 from the terminals 18 and 19 electrically connected with these electrodes.

Figure 9:
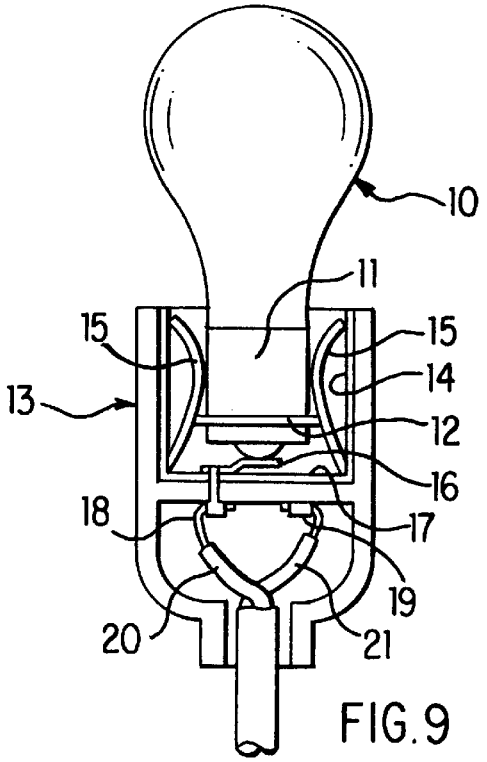
FIG. 9 shows a cross sectional view of the electric bulb according to the sixth embodiment of this invention held in a socket.

In the case of this embodiment, the electric bulb 10 is inserted into the socket 14 of the socket-like connector 13, pressing to widen the plate springs 15 with its base 11 and flange 12, until the terminal electrode on the base 11 of the electric bulb 10 comes into contact with the electrode 16 of the socket 13. Then as shown in FIG. 9, the plate springs 15 press the outer surface of the base 11 with their central convex areas 15. Even if the said electric bulb 10 is tried to be withdrawn from the socket 13, it is hard to be done because first each plate spring 15 pushes the outer surface 11 with its central convex part, and second the flange 12 is caught engaged with the said central convex part of each plate spring 15.

Figure 10:
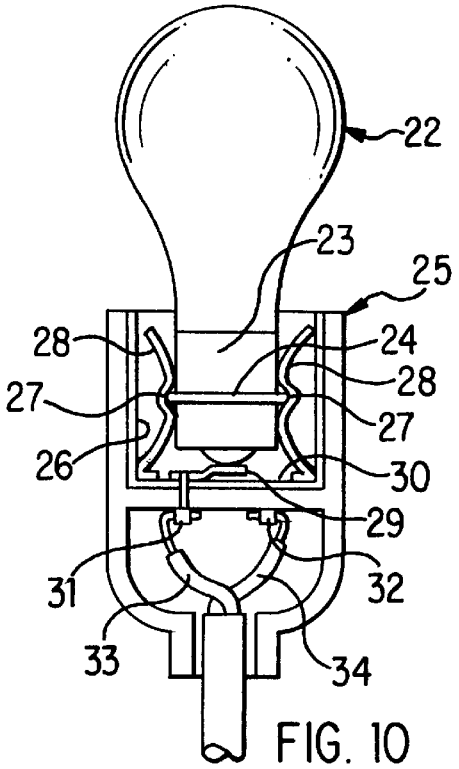
FIG. 10 shows a cross sectional view of the electric bulb according to the seventh embodiment of this invention held in a socket.

FIG. 10 shows the seventh embodiment of this invention which is applied to another electric bulb socket to hold an electric bulb. An electric bulb 22 has its base 23 shaped like a column, which has a flange 24 around its outer circumference, and the socket 25 has plate springs 28 as in the case of the fifth embodiment on its inner circumference 26 each having a groove 27 on its central convex part. Apart from these plate springs 28 that are used as the electrode on one hand, the electrode 29 on the other is provided on the bottom 30 of the socket 25, and the lead wires 33 and 34 are led out of the socket 25 from the terminals 31 and 32 electrically connected with these electrodes.

Figure 11:
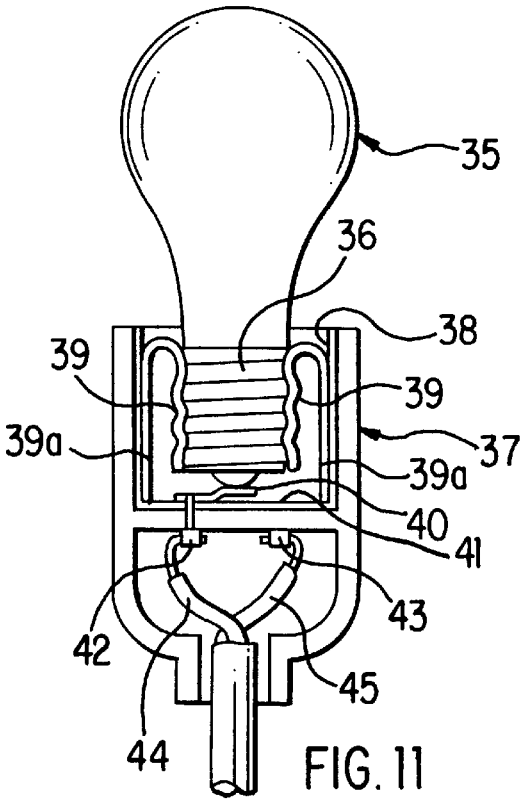
FIG. 11 shows a cross sectional view of the electric bulb according to the eighth embodiment of this invention held in a socket.

FIG. 11 shows the eighth embodiment of this invention applied to another electric socket to hold an electric bulb. The electric bulb 35 is a conventional one having a thread around the outer circumference of its base 36. The socket 37 also has the threaded-in-section plate springs 39 on its inner circumference, the said thread corresponding to the thread around the base 36, in parallel with the central shaft of the socket 37, with the bases 39*a* of these plate springs 39 fixed to the inner circumference 38 of the socket 37. Four plate springs 39 are provided at some interval on this inner circumference. These plate springs 39 are used as the electrode on one hand, with the other electrode 40 provided on the bottom 41 of the socket 38, and the lead wires 44 and 45 drawn out of the socket 37 from the terminals 42 and 43 electrically connected with these electrodes.

This eighth embodiment has the plate springs 39 with a corrugated cross section. When the electric bulb 35 base 36 is inserted into the hollow 36 of the socket 37, it pushes to widen the 4 plate springs 39 and passes through them, and as shown in FIG. 11, while the outer circumferential thread part of the base 36 is engaged with the thread of each plate spring 39, these plate springs 39 push the outer surface of the base 36, thereby securely support the electric bulb 35 in the socket 37.

Figure 12:
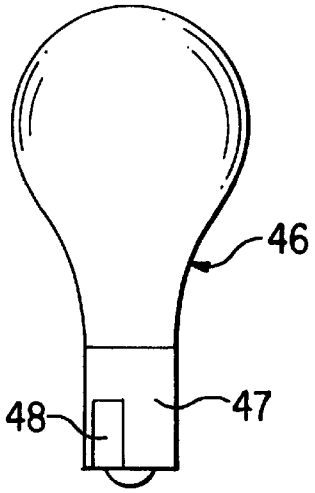
FIG. 12 shows an elevation of the electric bulb according to the ninth embodiment of this invention.
Figure 13:
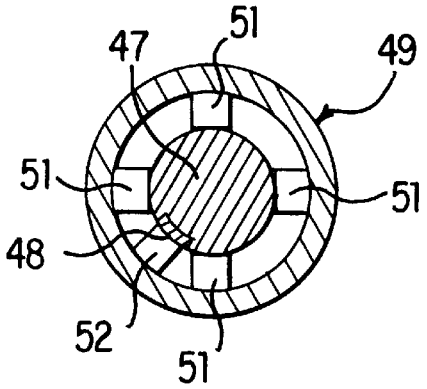
FIG. 13 shows a partially cross sectional plan of the electric bulb according to the ninth embodiment of this invention inserted into a socket.

From the sixth to the eighth embodiments use the plate springs 15, 28 and 39 as the electrode which is electrically connected with the bulb base. But this invention is not limited to this method but may use other material as the electrode in place of the plate springs. FIGS. 12 and 13 show the ninth embodiment of this invention which is applied to the electric socket, where the column-shaped base 47 of the bulb 46 is not conductive, but a conductive electrode 48 is exposed from a part of the outer circumference of the base 47. Four plate springs 51, made of an appropriate material, each with a central convex part are provided at some interval on the inner circumference 50 of the socket 49, and electrodes 52 supported by this inner circumference are provided between each two plate springs 51 and used as one electrode, while an electrode plate as the other electrode (not shown) is set on the bottom of the socket 50.

In this embodiment, when the base 47 of the bulb 46 is inserted under pressure among the plate springs 51 of the hollow 50 of the socket 49, and the electrode protruding from the top surface of the bulb base 47 comes into contact with the electrode plate on the bottom surface of the socket 49, the electrode 48 on the outer circumference of the base 47 contacts and is electrically connected with the electrode piece 52 of the socket 49.

Figure 14:
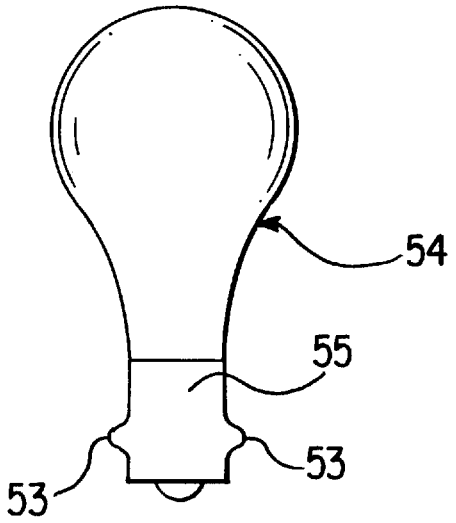
FIG. 14 shows an elevation of another example of the electric bulb according to the sixth and seventh embodiments of this invention.
Figure 15:
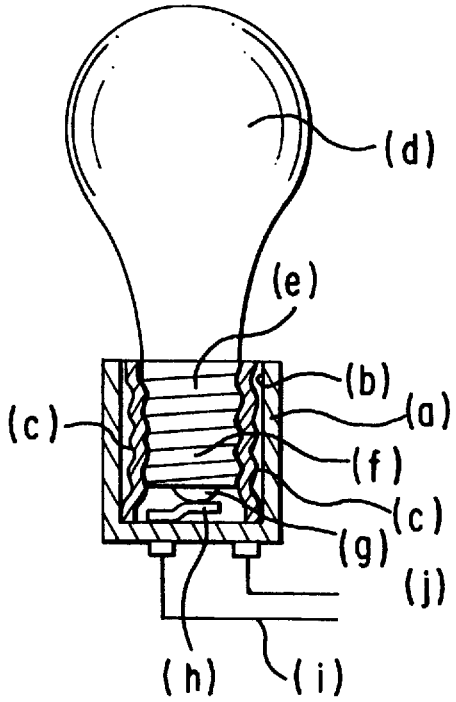
FIG. 15 shows a cross section of the conventional electric bulb held in a socket.

By the way, there is no need of providing a flange 12 as in the case of the sixth embodiment where a flange 12 was set on the base 11 of the bulb 10. Further, in the sixth and seventh embodiments, the flanges 12 and 24 of electric bulbs 10 and 22 are flat shaped, but it may be the flange with a certain thickness and the outer edge rounded out in cross section, as shown in FIG. 14. In this case, the flange 53 can be made in one with the bulb base 55 when it is molded, and such flanged electric bulbs can easily be produced by the same process as in the current type electric bulbs.

The plate springs according to this invention are not limited to those used in the above embodiments, but may be made of other appropriate materials and take other appropriate forms. Also, their installation direction and the method to fix them to the inner circumference of the socket are also not limited to those used in these embodiments, but any appropriate direction and fixing method may be used. Further, these plate springs to be installed within the socket may be appropriately selected in number; only one will do. Still further the plug of the said plug-shaped connector or the bulb base may be a column body with round, square or other appropriately shaped surface.

Industrial Feasibility

As mentioned above, this invention is applicable to the structure where a plug-shaped connector is connected with a socket-shaped connector, and to the structure where an electric bulb is connected with its socket. Not limited to these applications, this invention can widely be used as an alternative to the screw-in method in a variety of cases where anything is installed with screws, including screwing castors into the bottom ends of wagon legs, etc.

I claim:

1. In a structure to fit an electric bulb base into a socket-shaped connector, a structure to hold the electric bulb base in the socket comprising vertically curved elongated plate springs being provided at plural positions at some interval on an inner circumference of a hollow part of the socket-shaped connector, each plate spring with a first end thereof fixed in the hollow part and a second end thereof being movable with respect to inner side walls of the hollow part, these plate springs having rectangular horizontal cross-sections taken in a horizontal plane of the plate springs, these plate springs being biased inwardly and curved inwardly toward a longitudinal axis of the hollow part from said first end to said second end, and the inward curvatures of said plate springs defining a narrowest inner circumference at an intermediate transverse plane between the first ends and the second ends, said narrowest circumference having a diameter less than the electric bulb base for releasible engaging the electric bulb base when the electric bulb base is seated in the hollow part of the socket-shaped connector by the electric bulb base forcing the second ends of said plate springs against and along the inner side walls of the hollow part to increase the radius the inward curvature of said plate springs and move said plate springs outwardly the most at said intermediate transverse plans as said plate springs tend to flatten against the inner side walls of the hollow part.

2. In a structure to fit an electric bulb base having a circumferential flange into a socket-shaped connector, a structure to hold the electric bulb base in the socket comprising vertically curved elongated plate springs being provided at plural positions at some interval on an inner circumference of a hollow part of the socket-shaped connector, each plate spring with a first end thereof fixed in the hollow part and a second end thereof being movable with respect to inner side walls of the hollow part, these plate springs having rectangular horizontal cross-sections taken in a horizontal plane of the plate springs, these plate springs being biased inwardly and curved inwardly toward a longitudinal axis of the hollow part from said first end to said second end, and the inward curvatures of said plate springs defining a narrowest inner circumference at an intermediate transverse plane between the first ends and the second ends, said narrowest circumference having a diameter less than the electric bulb base for releasible engaging the electric bulb base when the electric bulb base is seated in the hollow part of the socket-shaped connector by the electric bulb base forcing the second ends of said plate springs against and along the inner side walls of the hollow part to increase the radius the inward curvature of said plate springs and move said plate springs outwardly the most at said intermediate transverse plans as said plate springs tend to flatten against the inner side walls of the hollow part and with the circumferential flange beneath said transverse plane.

3. In a structure to fit an electric bulb base into its socket and hold it there, a structure to hold said electric bulb base in its socket comprising said electric bulb base being shaped like a column and plural vertically curved elongated plate springs being provided at plural positions at some interval on an inner circumference of a hollow part of said socket, each plate spring with a first end thereof fixed in the hollow part and a second end thereof being movable, with respect to inner side walls of the hollow part these plate springs having rectangular horizontal cross-sections taken in a horizontal plane of the plate spring, these plate springs being biased inwardly and curved inwardly toward a longitudinal axis of the hollow part from said first end to said second end, and the inward curvatures of said plate springs defining a narrowest inner circumference at an intermediate transverse plane between the first ends and the second ends, said narrowest circumference having a diameter less than that of said bulb base for releasible engaging said bulb base when said bulb base is seated in the hollow part of said socket by said bulb base forcing the second ends of said plate springs against and along the inner side walls of the hollow part to increase the radius of the inward curvature of said plate springs and move said plate springs outwardly the most at said intermediate transverse plane as said plate springs tend to flatten against the inner side walls of the hollow part and with the circumferential flange beneath said transverse plane;

a first base electrode on a bottom surface of said hollow part for contacting a first bulb electrode on a bottom surface of said bulb base;

a second base electrode provided by at least one of said plate springs for contacting a second bulb electrode provided by a side surface of said bulb base; and first and second electrical leads electrically connected to said first and second base electrodes.

4. In a structure to fit an electric bulb base into its socket and hold it there, a structure to hold the electric bulb base in its socket comprising said electric bulb base being shaped like a column and plural vertically curved elongated plate springs being provided at plural positions at some interval on an inner circumference of a hollow part of said socket, each plate spring with a first end thereof fixed in the hollow part and a second end thereof being movable, these plate springs having rectangular horizontal cross-sections taken in a horizontal plane of the plate springs, these plate springs being biased inwardly and curved inwardly toward a longitudinal axis of the hollow part from said first end to said second end, and the inward curvatures of said plate springs defining a narrowest inner circumference at an intermediate transverse plane between the first ends and the second ends, said narrowest circumference having a diameter less than the electric bulb base for releasible engaging the electric bulb base when the electric bulb base is seated in the hollow part of the socket-shaped connector by the electric bulb base forcing the second ends of said plate springs against and along the inner side walls of the hollow part to increase the radius the inward curvature of said plate springs and move said plate springs outwardly the most at said intermediate transverse plans as said plate springs tend to flatten against the inner side walls of the hollow part and with the circumferential flange beneath said transverse plane.

5. In a structure to fit an electric bulb base into its socket and hold it there, a structure to hold the electric bulb base in its socket comprising a male thread being provided on the outer circumference of said electric bulb base, plural plate springs being provided at plural positions at some interval on an inner circumference of a hollow part of said socket each plate spring with a first end thereof fixed in the hollow part and a second end thereof being movable with respect to inner walls of said hollow part, these springs being vertically curved elongated and provided in directions from a proximity of opening to said hollow part of said socket, these plate springs having rectangular horizontal cross-sections taken in a horizontal plane of the plate spring, and the inner circumference surface of each plate spring matching in shape the male thread on the outer circumference of said bulb base; these plate springs being biased inwardly and curved inwardly toward a longitudinal axis of the hollow part from said first end to said second end, and the inward curvatures of said plate springs defining a narrowest inner circumference at an intermediate transverse plane between the first ends and the second ends, said narrowest circumference having a diameter less than that of said bulb base for releasible engaging said bulb base when said bulb base is seated in the hollow part of said socket by said bulb base forcing the second ends of said plate springs against and along the inner side walls of the hollow part to increase the radius of the inward curvature of said plate springs and move said plate springs outwardly the most at said intermediate transverse plane as said plate springs tend to flatten against the inner side walls of the hollow part.

6. A socket for receiving an elongated base of an electric bulb comprising:

a housing;

a cylindrically-shaped cavity formed in the housing and including a longitudinally extending axis, a cavity wall surface, and a cavity base surface extending transverse to said axis;

a plurality of plate springs extending longitudinally in said cavity with the first end of each being connected to said cavity base surface or to said cavity wall surface, and the second end thereof being movable with respect to said cavity wall surface, said plate springs each having rectangular transverse cross-sections there along and being biased inwardly and curved inwardly toward said axis from said first end to said second end, and the inward curvatures of said plate springs defining a narrowest inner circumference at an intermediate transverse plane between the first ends and the second ends, said narrowest circumference having a diameter less than that of the base of the electric bulb for releasible engaging the base of the bulb when the bulb is seated in the socket by the base of the bulb forcing the second ends of said plate springs against and along said cavity wall surface to increase the radius of the inward curvature of said plate springs and move said plate springs outwardly the most at said intermediate transverse plane as said plate springs tend to flatten against said cavity wall;

a first base electrode on said cavity base surface for contacting a first bulb electrode on a bottom surface of the base of the bulb;

a second base electrode provided by at least one of said plate springs for contracting a second bulb electrode provided by a side surface of the base of the bulb; and first and second electrical leads electrically connected to said first and second base electrodes.

7. The socket of claim 6 further comprising the electric bulb seated in the cavity with said plate springs releasible engaging the base of the bulb.

8. The socket of claim 6 wherein the base of the bulb is threaded about the outer surface thereof, and wherein each one of said plate springs is threaded to receive the threaded outer surface of the base of the bulb.

9. The socket of claim 6 wherein a flange is formed around the base of the bulb; and wherein said plate springs are bowed inwardly toward said axis above said flange when the bulb is seated in the socket.

10. The socket of claim 6 wherein a flange is formed around circumference of the base of the bulb; and wherein said plate springs are bowed inwardly toward said axis, and have grooves at the inward most portions thereof for receiving said flange when the bulb is seated in the socket.

* * * * *